US005534768A

United States Patent [19]

Chavannes et al.

[11] Patent Number: 5,534,768

[45] Date of Patent: Jul. 9, 1996

[54] REGULATED POWER SUPPLY HAVING WIDE INPUT AC/DC VOLTAGE RANGE

[75] Inventors: Theodore E. Chavannes, Thousand Oaks; Richard L. Walsworth, Westlake Village, both of Calif.

[73] Assignee: Harris Corporation, Melbourne, Fla.

[21] Appl. No.: 193,816

[22] Filed: Feb. 9, 1994

[51] Int. Cl.[6] ..... G05F 1/577

[52] U.S. Cl. ..... 323/267; 323/266; 323/272; 363/70; 307/75

[58] Field of Search ..... 363/15, 16, 17, 363/210, 142, 26, 55, 69, 70, 52, 95, 97, 50; 323/266, 267, 272; 307/11, 75, 52

[56] References Cited

U.S. PATENT DOCUMENTS

| | | | |
|---|---|---|---|
| 3,671,842 | 6/1972 | McKeown | 320/1 |
| 3,806,797 | 4/1974 | Johnson | 321/2 |
| 4,030,024 | 6/1977 | Chambers | 323/17 |
| 4,123,692 | 10/1978 | Gilmore et al. | 363/42 |
| 4,547,842 | 10/1985 | Beierholm | 363/35 |
| 4,581,694 | 4/1986 | Adams | 363/97 |
| 4,626,982 | 12/1986 | Huber | 363/80 |
| 4,717,849 | 1/1988 | Shigekane | 307/570 |
| 5,126,652 | 6/1992 | Carlin | 323/267 |
| 5,351,612 | 9/1994 | Koishikawa | 361/18 |

*Primary Examiner*—Jeffrey L. Sterrett
*Assistant Examiner*—Shawn Riley
*Attorney, Agent, or Firm*—Charles E. Wands

[57] ABSTRACT

A regulated power supply automatically accommodates either a positive or negative polarity connection of a power source and without regard as to whether the source is an DC or an AC source, and accommodating a wide range of input voltage sources. The power supply circuit includes a source voltage conditioning unit which includes an input fuse section, a surge protection circuit, a power switch, and a filter rectifier section, coupled in circuit between a set of external power source connection terminals and a set of output terminals from which a rectified and filtered intermediate voltage is derived. An open fuse detector alerts servicing personnel to an open condition of a user-replaceable input fuse. A DC-DC converter section includes a start up supply circuit and a primary drive winding of a power transformer connected to receive the intermediate rectified voltage from the filter rectifier of the input section. The primary drive winding is coupled to power switch MOSFETs, which drive the primary winding drive current under the control of a pulse width modulator (PWM). The outputs of plural secondary windings are rectified, filtered, and regulated. The rectified output of a selected secondary winding is monitored by way of current limiting and voltage feedback circuits to control the operation of the PWM.

6 Claims, 5 Drawing Sheets

REGULATED POWER SUPPLY HAVING WIDE INPUT AC/DC VOLTAGE RANGE

FIELD OF THE INVENTION

The present invention relates in general to power supply circuits, and is particularly directed to a power supply circuit which is operative to provide, from a wide range of input voltage sources including both AC and DC sources, a plurality of regulated output voltages, such as those employed by communication (e.g. telephone) equipment and control circuits therefor.

BACKGROUND OF THE INVENTION

The ongoing development of communication (e.g. telephone) systems and associated components has resulted in the integration of high speed digital processing devices with conventional analog components and systems. Because the electrical and electronic signal levels of analog and digital devices differ significantly from each other (e.g. +/–48 VDC for analog telephone equipment and +5 VDC for digital signal processing/control devices), integrated systems are often fitted with separate power supplies, each dedicated to a respective application.

Proposals to limit the hardware intensity associated with the use of separate power supplies have included multi-capability power supply units, that may be selectively configurable by the user, as by means of jumper cables or switches, to accommodate operating the power supply from either an (117V) AC source, or a DC source. Because such power supply units require intervention by either the user or a craftsperson, their installation and use is labor intensive. Moreover, the range of input sources from which such units may be powered is ordinarily limited to a relatively small ratio (e.g. on the order of 2:1), so that the complexity (and therefore cost) of the hardware is not insubstantial.

SUMMARY OF THE INVENTION

In accordance with the present invention, the above-described shortcomings of conventional power supply systems employed in communication signal processing applications that require a wide range of output voltages derived from an extensive range and different types of input power sources are successfully addressed by a new and improved power supply circuit, which is operative to produce a plurality of regulated D.C. voltages, such as those employed by communication (e.g. telephone) equipment and control circuits therefor, from both AC and DC sources, such as a –48 VDC source and a 117 VAC source, without regard to the polarity of the connection of the power supply circuit to the power source. In addition, the regulated power supply circuit of the present invention is provided with an open fuse detector and alarm circuit, which is operative to signal an open or blown condition of a user-replaceable input fuse, which protects the power supply circuit from excessive input current.

For this purpose, the power supply circuit includes a source voltage conditioning unit which includes an input fuse section, a surge protection circuit, a power switch, and a filter rectifier section, coupled in circuit between a set of external power source connection terminals and a set of output terminals from which a rectified and filtered intermediate voltage is derived. The open (blown) fuse detector is coupled to the input fuse section and is operative to provide an open fuse alarm output in response to the occurrence of an open fuse condition of the input fuse section.

As noted above, the external power source connection terminals may be coupled to either a conventional DC power source (e.g. on the order of –48 VDC) or AC power source (e.g. on the order of 117 VRMS), and without preference to polarity of the source terminals. The input fuse section includes a main fuse which handles maximum input current during maximum power supply loading on all outputs, and also can withstand a prescribed industry standard line surge (e.g. 6 kV, 3 kA class B lightning strike) without failure.

The surge protection circuit may comprise metal oxide varistor (MOV) devices. The power switch is operative to connect input power lines through an inrush-limiting surge thermistor and an RFI filter to a bridge rectifier within the filter rectifier section. The rectified (DC) voltage output of the bridge rectifier is coupled to a filter section which provides a filtered unregulated intermediate DC voltage across the set of output terminals for operating a downstream DC-DC converter section.

The open fuse detector preferably comprises a first bridge rectifier coupled to the line upstream of the main fuse through a reduced current fuse, and a second bridge rectifier which is coupled downstream of the main fuse. The use of these bridge rectifiers allows the open fuse detector to operate from either an AC voltage source or a DC voltage source of either polarity. The upstream bridge rectifier has a return path to the line for supplying power to the open fuse detector circuit.

The downstream bridge rectifier has a return path to the line and its output terminals are coupled to drive a blown fuse-sensing opto-isolator, which is coupled to the gate of a MOSFET switch. The source-drain path of the MOSFET switch is coupled in circuit with a light emitting diode and an alarm relay. Contacts of the relay are connectable to an alarm device. In the absence of an open main fuse condition, the downstream bridge rectifier drives the opto-isolator which, in turn, keeps the MOSFET switch turned-off. In the event of an open main fuse condition, however, the downstream bridge rectifier becomes decoupled from the line and therefore no longer drives the opto-isolator. As a consequence, through a gate drive circuit, the MOSFET switch is turned-on, causing the blown fuse LED to be illuminated and operating the alarm relay.

The DC-DC converter section includes a start up supply circuit and a primary drive winding of a power transformer connected to receive the intermediate rectified voltage from the filter rectifier of the input section. The primary drive winding is coupled to parallel-connected power switch MOSFETs, which are operative to controllably switch the primary winding drive current under the control of a pulse width modulator (PWM).

The start up supply circuit includes a MOSFET switch, the drain-source path of which is coupled in circuit with the DC input and an input voltage supply (VCC) port of the PWM. The gate of the MOSFET switch is driven by a Zener voltage, to provide a start up supply voltage for a PWM bias supply circuit. The PWM bias supply circuit is coupled to respective winding terminals of a power supply winding of the power transformer.

The PWM provides a modulated (variable pulse width) output voltage to the gates of the power MOSFET switches which controllably modulate or 'chop' the current through the primary of the power transformer, and thereby controllably modulate the voltage across respective ones of a plurality of secondary windings. The modulated voltages across the secondary windings are rectified and filtered to provide respectively different magnitude output voltages (e.g. +/–105 VDC, +/–17 VDC, and +5 VDC/GND).

The primary switching MOSFETs have their source terminals coupled through a primary current sense filter and attenuator circuit to a current sense input port of the PWM. The filter and attenuator circuit provides current limit level signal which serves as the primary pulse width control input of the PWM. The PWM has a voltage reference port which provides a prescribed voltage reference (e.g. 5 VDC), for providing power to a number of circuit components.

The PWM also has a compensation input/output port which is coupled to a 'soft start' circuit, which is operative to limit the rate of rise of the output voltages when the PWM is powered up. The soft start circuit provides current amplification and sinks current sourced by an error amplifier circuit through an opto-isolator. Once a regulated output is stabilized, the soft start circuit is decoupled from the voltage control loop of the PWM.

The compensation input/output port of the PWM is also coupled to the opto-isolator circuit through coupling/biasing resistors which are coupled to a voltage feedback port of the PWM. The voltage feedback port provides a second control input to the PWM, in addition to current sense input port, for controlling the modulated output waveform used to drive the power MOSFETs.

The opto-isolator has a first input coupled to a +5 VDC output terminal on the secondary side of the power transformer. A second input of the opto-isolator is coupled to an error sensing differential amplifier. A feedback voltage reference circuit provides a prescribed reference voltage derived from the +5 VDC output voltage. The differential amplifier compares this voltage with a feedback voltage which is derived by way of a trimmable resistor network. The trimming network is trimmed during manufacture by providing a jumper connection between respective points of select jacks.

That secondary winding of the transformer from which the +5 VDC output is derived is coupled through a single torroid winding and a ripple filter circuit to an output terminal. Inserted into the central aperture of a sense coil of a +5V current limit circuit is a torroid winding, which monitors the peak rectified current from the secondary winding. The current limit circuit is coupled to the voltage feedback port of the PWM and is operative to apply an input to this port when the current provided by the +5V secondary winding of the power transformer exceeds a prescribed threshold, which causes the PWM to reduce its output.

The modulated voltages across the secondary windings of the power transformer are rectified and filtered to provide respectively different magnitude output voltages of complementary polarities. Except for the +5 VDC secondary output, these rectified and filtered voltages are coupled to respective voltage regulator circuits, from which the positive and negative regulated output voltages of the power supply are derived.

DETAILED DESCRIPTION

Figure 1:
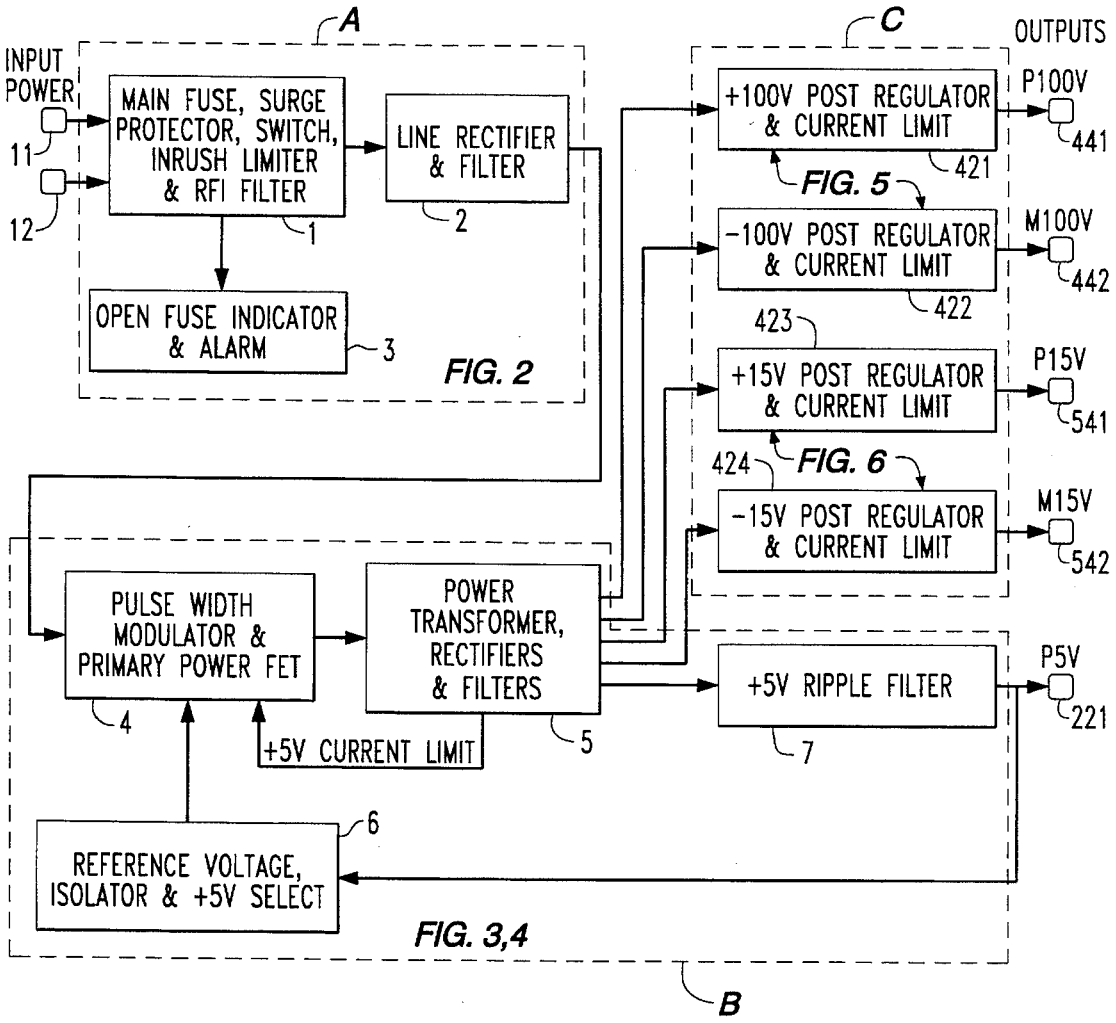
FIG. 1 is a block diagram of the circuit architecture of the regulated power supply of the present invention.

A block diagram of the circuit architecture of the regulated power supply of the present invention is shown in FIG. 1 as comprising a source voltage conditioning section A (shown in detail in the schematic of FIG. 2, to be described), which includes an external source connection to input unit 1, which is coupled to a set of input (external power source connection) terminals 11 and 12. External power source connection terminals 11 and 12 may be coupled to either a conventional DC power source (typically on the order of –48 VDC) or AC power source (typically on the order of 117 VRMS) without preference to polarity of the source terminals.

Input unit 1 includes an input fuse section containing a user-replaceable main line fuse and a reduced capacity auxiliary fuse through which an open fuse detector is powered, a surge protection circuit, a power switch, and a filter section. As will be described in detail below, the surge protection circuit preferably comprises a set of metal oxide varistor (MOV) devices. The power switch of unit 1 is operative to connect input power lines through an inrush-limiting surge thermistor and an RFI filter to a bridge rectifier within a filter-rectifier section 2, which provides a filtered, unregulated intermediate DC voltage across the set of output terminals for operating a DC-DC converter section, shown at B. Also coupled to the input fuse section of unit 1 is an open fuse detector and alarm circuit 3, which is operative to provide an open fuse alarm output in response to the occurrence of an open fuse condition of the input fuse section of unit 1.

Figures 2, 3:
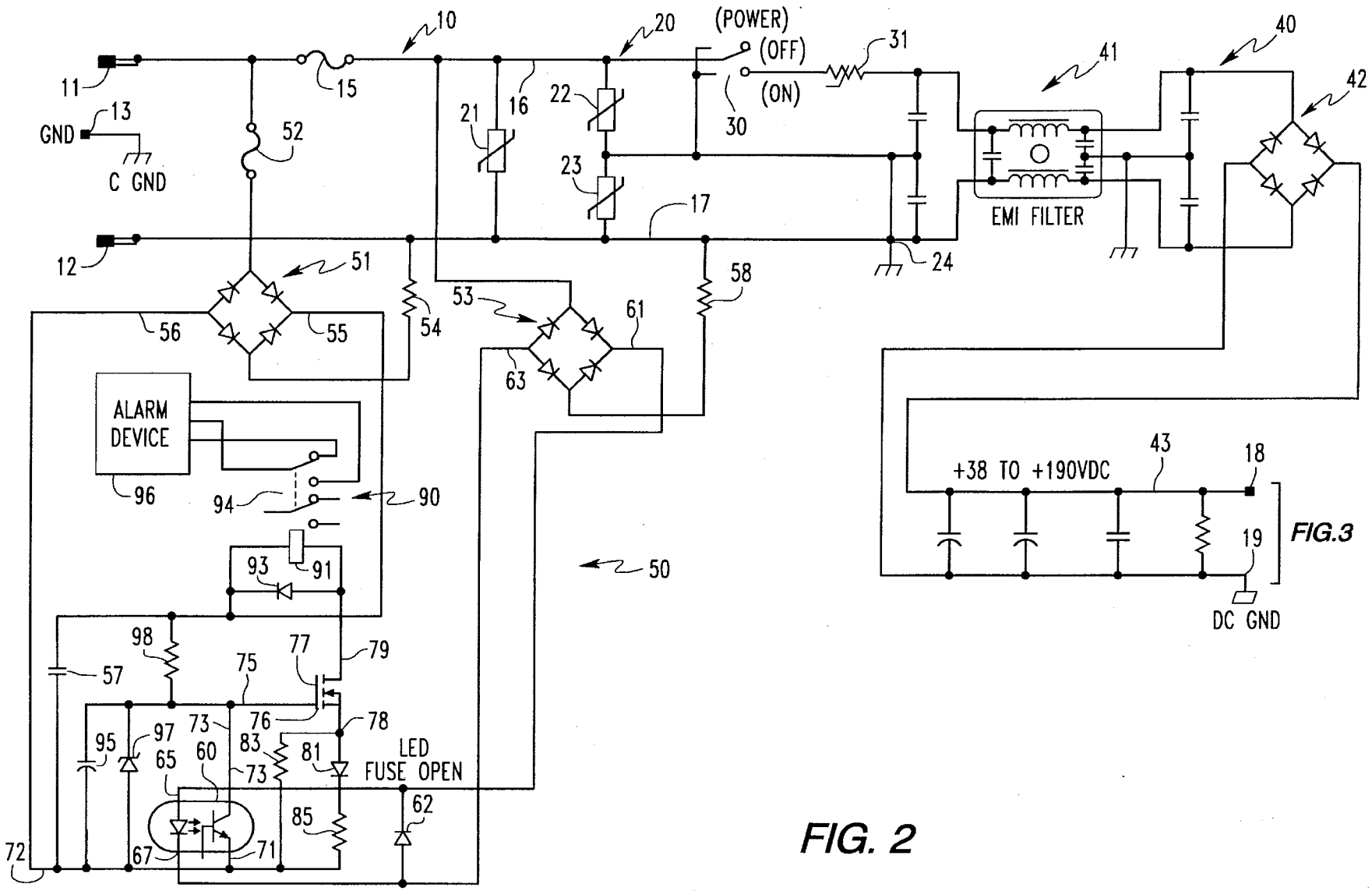
FIG. 2 schematically illustrates the source voltage conditioning section A of the regulated power supply diagram of FIG. 1.
FIGS. 3 and 4, taken together, show the details of the DC-DC converter section B of the regulated power supply diagram of FIG. 1.
Figure 3:
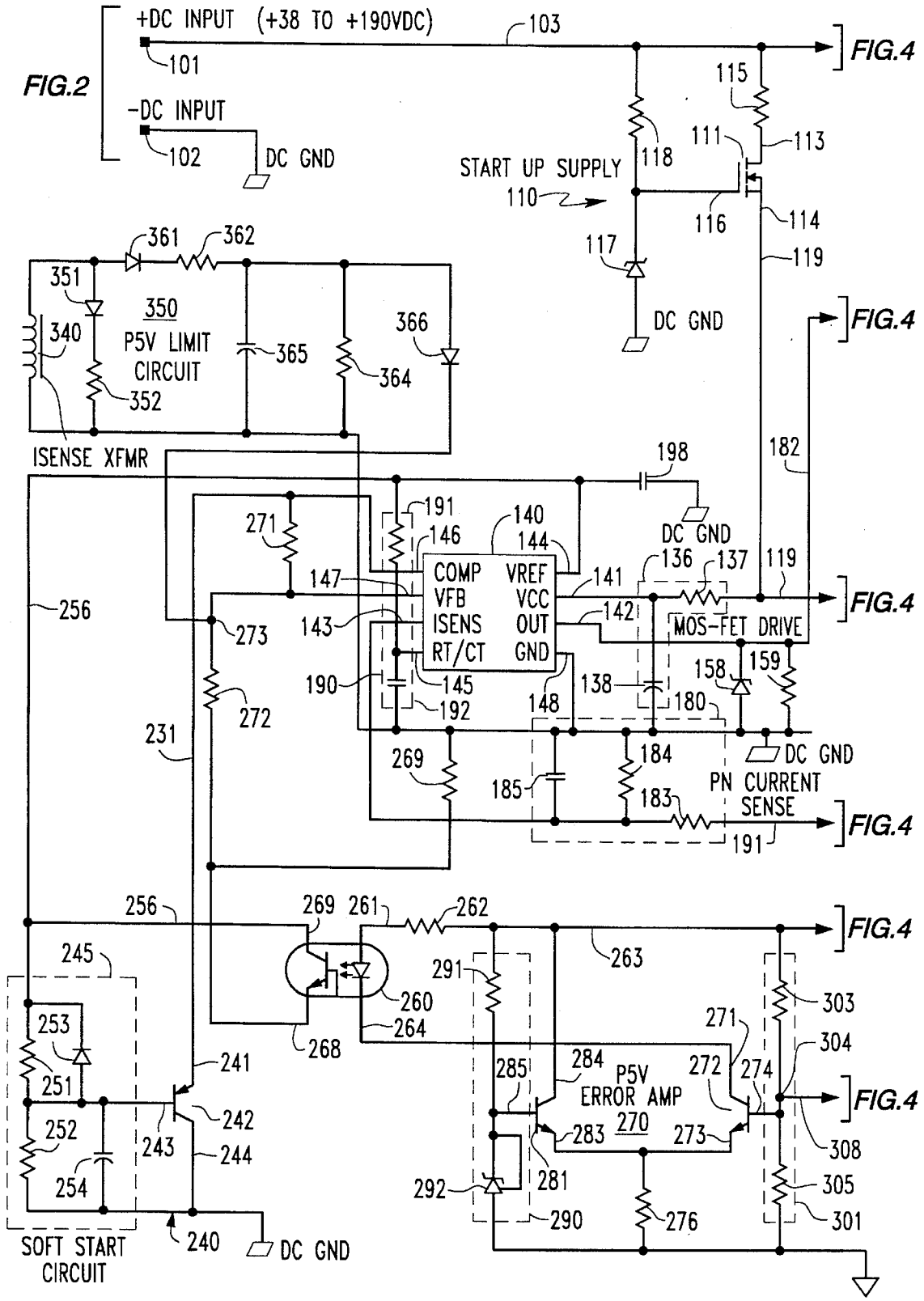
Figure 4:
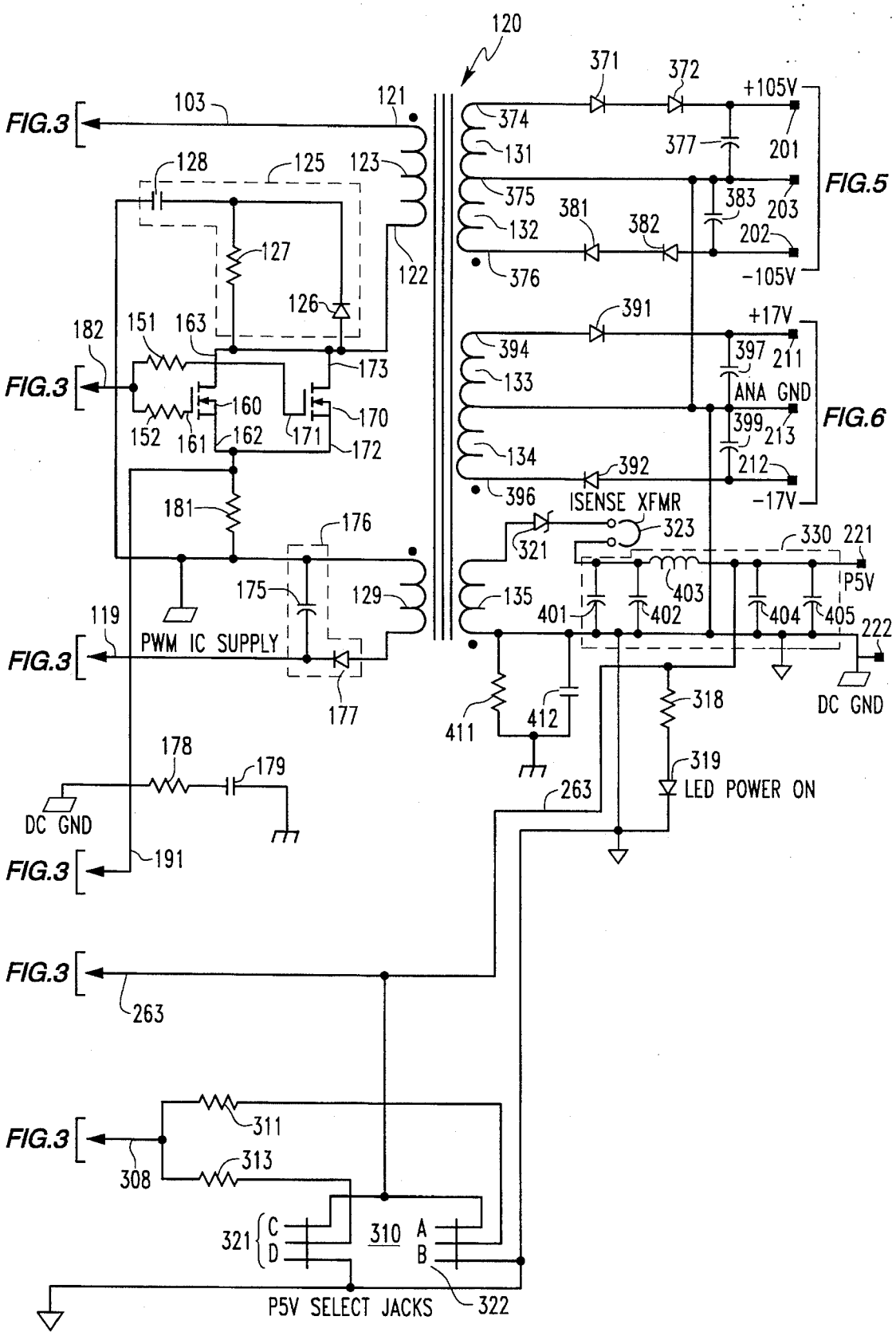

The DC-DC converter section B (details of which are shown in FIGS. 3 and 4, to be described) includes a pulse width modulator (PWM) and power switching FET unit 4, which is operative to controllably switch the primary winding drive current of a power transformer, rectifier and filter unit 5. PWM and power switching FET unit 4 includes a start up supply circuit, that provides start up supply voltage for a PWM bias supply circuit. The PWM bias supply circuit is coupled to respective winding terminals of a power supply winding of the power transformer of power transformer, rectifier and filter unit 5.

The PWM outputs a variable pulse width voltage to the gates of the parallel-connected power FETs, which controllably chop the current applied to power transformer unit 5, and thereby modulate the voltage across respective ones of a plurality of secondary windings. The modulated voltages across the transformer's secondary windings are rectified and filtered to provide respectively different magnitude output voltages (e.g. +/–105 VDC, +/–17 VDC, and 5 VDC/GND), for application to a regulator and current limit section, shown at C.

The power MOSFETs of PWM and power switching FET unit 4 are coupled through a primary current sense filter and attenuator circuit to a current sense input port of the PWM. The filter and attenuator circuit provides current limit level signal, coupled via the unit 5, which serves as the primary pulse width control input of the PWM. Also coupled to the PWM unit 4 is a reference voltage unit 6, which provides a prescribed voltage reference for unit 4. Reference voltage unit 6 also includes a 'soft start' circuit, which is operative to limit the rate of rise of the output voltages when the PWM is powered up.

The soft start circuit provides current amplification and sinks current sourced by an error amplifier circuit through an opto-isolator. The PWM also has a voltage feedback port coupled to the opto-isolator circuit. The voltage feedback port provides a second control input to the PWM, in addition to current sense input port, for controlling the modulated output waveform used to drive the power MOSFETs. The opto-isolator of unit 6 is coupled to an error sensing differential amplifier, which compares a reference voltage derived from the +5 VDC output voltage of the power supply with a feedback voltage.

Within power transformer unit 5, the secondary winding from which the +5 VDC output is derived is magnetically coupled to a +5V current limit circuit, which monitors the peak rectified current from the secondary winding. The current limit circuit is coupled to the voltage feedback port of the PWM and is operative to apply an input to this port when the current provided by the +5 V secondary winding of the power transformer exceeds a prescribed threshold, which causes the PWM to reduce its output.

The modulated voltages across the secondary windings of the power transformer unit 5 are rectified and filtered to provide respectively different magnitude output voltages of complementary polarities. Except for the +5 VDC secondary output, which is filtered by way of a +5V ripple filter unit 7, these rectified and filtered voltages are coupled to voltage regulator and current limit section C. Voltage regulator and current limit section C contains respective voltage regulator circuits 421, 422, 423 and 424 (shown in detail in FIGS. 5 and 6, to be described), from which the positive and negative regulated output voltages of the power supply are derived.

Referring now to FIG. 2, the source voltage conditioning section A of the regulated power supply of the present invention is schematically illustrated as comprising an input fuse section 10, an overvoltage, surge protection circuit 20, a power switch 30, and a filter rectifier section 40, which are coupled in circuit between input terminals 11 and 12 and a set of output terminals 18, 19. Also coupled to input fuse section 10 is an open (blown) fuse detector circuit 50 which is operative to provide an open fuse alarm output in response to the occurrence of an open fuse condition of input fuse section 10.

As described previously, input terminals 11 and 12 may be coupled to either a conventional DC power source (e.g. within a range of −42 volts minimum to −58 volts maximum, and typically on the order of −48 VDC) or AC power source (e.g. within a range of 95 VAC RMS minimum to 135 volts AC RMS maximum, typically on the order of 117 VRMS) without preference to polarity of the source terminals. A reference ground terminal is also shown at 13. Physical connection of terminals 11, 12 (and 13) to an external power source may be accomplished by using a single attached power cord, plugable into either a DC cord or an AC cord.

Input fuse section 10 comprises a main fuse 15 which is shown as coupled in line 16 between input terminal 11 and power switch 30. Main fuse 15 is operative to handle the maximum input current during maximum power supply loading on all outputs, and also withstand a prescribed industry standard line surge (e.g. 6 kV, 3 kA) without failure.

Overvoltage, surge protection circuit 20 is shown as being comprised of a first metal oxide varistor (MOV) element 21 connected across input lines 16 and 17, and a set of MOV elements 22, 23 which are connected in series across input lines 16 and 17 and also to chassis ground, shown at 24. The MOVs are rated for 150 VAC continuous operating voltage and limit a voltage surge to a value on the order of 700 volts peak.

Power switch 30, when closed from its normally open position shown in FIG. 2, connects input power lines 16 and 17 (through an inrush-limiting surge thermistor 31 coupled in circuit with line 16) to an RFI filter 41 to a bridge rectifier 42 within filter rectifier section 40. The (rectified) output of bridge rectifier 42 is coupled to a filter section 43, which provides a filtered unregulated DC voltage across output terminals 18 and 19 for operating the DC-DC converter section.

Open fuse detector 50 comprises a first bridge rectifier 51, which is coupled to the line voltage side (input terminal 11 side or upstream) of main fuse 15 through a reduced current fuse 52, and a second bridge rectifier 53, which is coupled to the load voltage side (output terminal 18 side or downstream) of main fuse 15. The use of bridge rectifiers 51 and 53 allows the open fuse detector to operate for both an AC voltage and a DC voltage of either polarity. Bridge rectifier 51 has a return path to line 17 through resistor 54 and its output terminals 55 and 56 supply power for operating the open fuse detector circuit 50. A capacitor 57 is coupled in circuit with output terminal 55 of bridge rectifier 51 and is charged to a voltage slightly less than the peak line voltage due to resistor 54.

Bridge rectifier 53 has a return path to line 17 through a resistor 58 and its output terminals 61 and 63 are coupled to drive the input terminals 65 and 67 of a blown fuse-sensing opto-isolator circuit element 60. A diode 62 is coupled across terminals 65 and 67 of opto-isolator 60 to protect it against large reverse voltage spikes from the line. A first output terminal 71 of opto-isolator circuit element 60 is coupled through line 72 to output terminal 56 of bridge rectifier 51, while a second output terminal 73 of opto-isolator circuit element 60 is coupled through line 75 to the gate terminal 76 of a MOSFET switching transistor 77. The source terminal 78 of MOSFET 77 is coupled to the anode of an light emitting diode (LED) 81 and a current bypass resistor 83. The cathode of LED 81 is coupled to line 72 through resistor 85. The drain 79 of MOSFET 77 is coupled to the winding 91 of a relay 90, and to a protection diode 93, which protects MOSFET from a turn-off voltage spike across relay winding 91. Relay 90 has contacts 94 which are connectable to an alarm device 96 (such as an audio alarm device), which is operative to generate a suitable alarm signal in response to circuit 50 detecting an open fuse condition, as will be described. The gate terminal 76 of MOSFET 77 is also coupled to a filter capacitor 95, a Zener diode 97, which is operative to clamp the gate voltage of the MOSFET at a prescribed voltage (e.g. 12 VDC), and through a resistor 98 to terminal 55 of bridge rectifier 51.

In operation, voltage present at input terminals 11 and 12 on the input or line side of the main fuse 15, is coupled through bridge rectifier 51 and powers the circuit. During normal power supply operation, namely, in the absence of an open main fuse condition, bridge rectifier supplies power to opto-isolator 60, so that it may sink current supplied through resistor 98 from bridge rectifier 51. As long as opto-isolator 60 is turned-on the voltage applied to gate terminal 76 of MOSFET 77 is insufficient to render MOSFET conductive, so that no drain-source current flow path is provided through MOSFET 77.

In the event of an open main fuse condition, however, bridge rectifier 53 no longer provides input drive to opto-isolator circuit element 60. As a consequence capacitor 95 is gradually charged through resistor 98. Eventually, the voltage on capacitor 95 reaches the gate turn-on voltage of MOSFET 77. When MOSFET 77 turns on, it provides a current flow path from bridge terminal 55 to terminal 56 though relay winding 91, thereby closing contacts 94 to operate an attendant alarm device 96, and through LED 81, which becomes illuminated. By-pass resistor 83 protects LED 81 by shunting the larger magnitude relay winding current around LED 81.

Referring now to FIGS. 3 and 4, taken together, the circuit configuration of the DC-DC converter section B of the regulated power supply of the present invention is schematically shown as comprising respective (+) and (–) DC input terminals 101, 102 to which the unregulated DC voltage output terminals 18 and 19 of the filter section 43 of FIG. 2 are connected. The (–) input terminal 102 is coupled to DC ground reference potential, while the (+) input terminal 101 is coupled via line 103 to a start up supply circuit 110, and to a first end 121 of a primary drive winding 123 of a power transformer 120. A second end 122 of primary drive winding 123 of transformer 120 is coupled to the drain terminals 163, 173 of respective power switch MOSFETs 160 and 170. Drain terminals 163, 173 are coupled via a snubber circuit 125 to DC ground. Snubber circuit 125 comprises a diode 126, resistor 127 and capacitor 128, which serve to control the voltage overshoot during the turn-off transitions of MOSFETs 160 and 170, and also help control drain voltage ringing during the turn-off intervals of the MOSFETs.

Start up supply circuit 110 is comprised of a MOSFET switch 111, the drain 113 of which is coupled through a resistor 115 to (+) DC line 103 and the source 114 of which is coupled via line 119 through a resistor-capacitor filter 136, comprised of resistor 137 and capacitor 138, to the input voltage supply (VCC) port 141 of a pulse width modulator circuit (PWM) 140. MOSFET switch 111 has its gate terminal 116 coupled to the junction of a Zener diode 117 and a resistor 118, which are connected in series between (+) DC line 103 and ground. Zener diode 117 regulates the gate voltage applied to MOSFET 111 to a prescribed value (e.g. on the order of fifteen volts), with the gate-to-source voltage drop across MOSFET 111 being low enough (e.g. on the order of four volts) to provide a predetermined source voltage (e.g. eleven volts) sufficient to meet the power up requirements of the VCC port 141 of PWM 140. Resistor 115 limits the inrush current required to charge a capacitor 175 of a PWM bias supply circuit 176. PWM bias supply circuit 176 is coupled to respective winding terminals of a power supply winding 129 of power transformer 120, and includes a diode 177 which provides a rectified voltage that maintains capacitor 175 charged during operation of PWM 140.

Pulse width modulator circuit (PWM) 140 may comprise a commercially available fixed frequency current mode controller, such as a model SG1845Y, manufactured by Silicon General Corp., which has a controllable duty factor range on the order of 0–50%. PWM 140 provides a modulated (variable pulse width) output voltage on pulse width modulation output port 142, which is coupled via line 182 through respective oscillation inhibiting resistors 151 and 152 to the gate terminals 161 and 171 of power MOSFET switches 160 and 170. Coupled between line 182 and ground are a Zener diode 158 and a resistor 159. Zener diode 158 is operative to prevent excessive transient voltages from being applied to the gate terminals 161, 171 of MOSFETs 160, 170, while resistor 159 maintains the off gate voltages near zero volts (ground). A resistor 178 and a capacitor 179 couple DC ground to chassis ground to reduce conducted RFI emissions.

MOSFET switches 160 and 170 have their drain-source paths coupled in circuit with the primary drive winding 123 of transformer 120, and are operative to controllably modulate or 'chop' the current through power transformer 120, and thereby controllably modulate the voltage across respective ones of a plurality of secondary windings 131–135. The modulated voltages across secondary windings 131–135 are rectified and filtered to provide respectively different magnitude output voltages (+/–105 VDC, +/–17 VDC, and +5 VDC/GND) at terminals 201–203, 211–213, 221–222, as will be described.

MOSFETs 160 and 170 have respective source terminals 162, 172 coupled through a sense resistor 181 to DC ground, and via a line 191 to a primary current sense filter and attenuator circuit 180, comprised of voltage divider resistors 183, 184 and capacitor 185 to a current sense input port 143 of PWM 140. Filter and attenuator circuit 180 is operative to provide current limit level control and to filter out voltage overshoot due to the inductance of sense resistor 181.

Current sense input port 143 serves as the primary pulse width control input of PWM 140; namely, the width or duty cycle of the output pulse signal generated by PWM on modulation output port 142 is dependent upon the voltage coupled to current sense input port 143, based upon the primary winding current sensed via sense resistor 181. The operating frequency of the pulse width modulation output signal generated by PWM 140 is defined by an RC time constant circuit 190 comprised of a resistor 191 and a capacitor 192 coupled in circuit between DC ground and a voltage reference (VREF) port 144 of PWM 140. The junction 145 of RC time constant circuit 190 is coupled to frequency control input 145 of PWM 140. When PWM 140 is powered up, its voltage reference port 144 provides a prescribed voltage reference (e.g. +5 VDC), which is employed to power a number of circuit components, as will be described. A capacitor 198 provides a low AC impedance bypass path to ground for the VREF port 144.

PWM 140 has a compensation input/output port 146 coupled via line 231 to the emitter 241 of a common collector-configured PNP bipolar transistor 242 within a 'soft start' circuit 240. The base 243 of transistor 242 is coupled through a bias and filter network 245 comprised of resistors 251, 252, diode 253 and capacitor 254 via line 256 to the (+5V) VREF output port 144 of PWM 140. Soft start circuit 240 is operative to limit the rate of rise of the output voltages when the PWM 140 is powered up, in order to minimize component stress and to satisfy inrush current requirements. Capacitor 254 is charged via the VREF path through resistor 251. Transistor 242 is operative to provide current amplification and to sink current sourced by an error amplifier circuit 270, through an opto-isolator 260, to be described. Transistor 242 is turned off and thereby decouples the soft start circuit from voltage control loop of the PWM 140, once a regulated output is stabilized. Diode 253 provides a rapid discharge path for capacitor 254, to insure adequate slow starts during subsequent cycling of the input voltage.

The compensation input/output port 146 of PWM 140 is also coupled to a first output terminal 268 of an opto-isolator circuit 260 through coupling/biasing resistors 271 and 272, the junction 273 between which is coupled to voltage feedback port 147 of PWM 140. A bias resistor 269 is coupled between ground and terminal 268. Voltage feedback port 147 provides a second control input to the PWM 140 (in addition to current sense input port 143) for controlling the modulated output waveform at port 142. A second output terminal 269 of opto-isolator circuit 260 is coupled to line 256 to which the VREF (+5) output voltage of PWM 140 is supplied.

Opto-isolator 260 has a first input terminal 261 coupled via an output current limiting resistor 262 and a line 263 to the (+)5 VDC output terminal 221 on the secondary side of power transformer 120. A second input 264 of opto-isolator 260 is coupled to the collector 271 of an NPN bipolar transistor 272 of a bipolar differential amplifier 270. Transistor 272 has its emitter 273 coupled in common with the emitter 283 of NPN transistor 281 and through a resistor 276 to ground. The collector 284 of transistor 281 is connected to line 263, and the base 285 of transistor 281 is connected to a feedback voltage reference circuit 290 comprised of a resistor 291 and a reference integrated circuit 292, coupled in series between line 263 and ground. Feedback voltage reference circuit 290 provides a prescribed reference voltage derived from the (+5V) voltage of line 263. Differential amplifier 270 compares this voltage with a scaled feedback voltage applied to the base 274 of bipolar transistor 272 of differential amplifier 270.

The scaled base voltage of transistor 272 is derived by way of a voltage divider 301 comprised of resistors 303 and 305, which are coupled in circuit between line 263 and ground. The junction 304 of voltage divider network 301 is coupled through line 308 resistors 311 and 313 of a resistor trimming network 310, which is coupled between line 263 and ground. Resistor trimming network 310 is trimmed during manufacture by measuring the output voltage on terminal 221 and providing the appropriate jumper connection between respective connection points (A, B, C, D) of a pair of select jacks 321 and 322, in accordance with the connection chart shown below, for the desired voltage setting. Also coupled between line 263 and ground is a series circuit of an LED 319 and an associated current control resistor 318. When the supply circuit is powered up and the main fuse is closed in the line, LED 319 is illuminated.

CONNECTION CHART (ACCEPTABLE RANGE = 5.010–5.055)

| NO JUMPER +5 V MEASURED | JUMPER(S) TO INSTALL |
|---|---|
| 4.910–4.945 | B & D |
| 4.945–4.980 | D |
| 4.980–5.015 | B |
| 5.015–5.050 | NONE |
| 5.050–5.085 | A |
| 5.085–5.120 | C |
| 5.120–5.155 | A & C |

Secondary output winding 135 of transformer 120, from which the (+5 VDC) output on terminal 221 is derived, is coupled through a diode 321 through a single torroid winding 323 and a ripple filter circuit 330 to output terminal 221. Inserted into the central aperture of sense coil 340, shown in FIG. 3, is the torroid winding 323, so as to magnetically couple the modulated current flowing through winding 323 to sense coil 340. Sense coil 340 is contained within a (+5V) current limit circuit 350 and is operative to monitor the peak current through diode 321 on the secondary side 135 of transformer 120. Since the current through sense coil 340 is proportional to the current through winding 323, circuit 350 provides a voltage representative of the current flowing through the +5V secondary side 135.

Coupled across sense coil 340 is a series connection of a diode 351 and a resistor 352, which provides a load for the majority of current provided by coil 340. Coupled in series with sense coil 340 is a series connection of a diode 361 and a resistor 362, coupled in circuit with resistor 364 and capacitor 365, which establish the current limit level and function as a low pass filter. Current limit circuit 350 is coupled to the voltage feedback port 147 of PWM 140 by a diode 366. Diode 366 is rendered conductive when the current provided by the (+5V) secondary winding 135 of power transformer 120 exceeds a prescribed threshold (e.g. on the order of 1.5 amps), so that the output of the PWM 140 will be adjusted. As long as the current provided by the (+5V) secondary winding 135 of power transformer 120 does not exceed the threshold, diode 366 decouples the current limit circuit 350 from port 147 of PWM 140, so that the current limit circuit 350 is not part of the PWM control loop.

The operation of the DC-DC converter section proceeds as follows. During power-up, the rectified voltage on line 103 causes MOSFET switch 111 to be gated on, to provide a source voltage sufficient to power up the VCC port 141 of PWM 140, and to charge a capacitor 175 of PWM bias supply circuit 176. As noted above, the PWM bias supply circuit 176 is coupled to respective winding terminals of power supply winding 129, with diode 177 providing a rectified voltage that maintains capacitor 175 charged during the operation of PWM 140.

When the voltage at VCC port 141 reaches a prescribed threshold (e.g. on the order of 8 volts or so), PWM 140 begins generating output pulses on line 142. These pulses gradually charge up the bias supply filter capacitor 175 via diode 177 and winding 129 of power transformer 120. When the DC-DC converter reaches voltage regulation, the bias voltage is between some defined limits (e.g. +13 and 18 volts), depending upon the loads. When this happens, the start-up current through MOSFET switch 111 drops to near zero, as its gate-to-source voltage is biased beyond cutoff.

During its generation of the pulse width modulated signal on line 142, PWM 140 has its pulse width controlled by both the voltage feedback or COMP input/output port 146 and the current feedback or ISENS port 143. As described above, voltage feedback is readily derived by observing the output of the error amplifier 270. For normal voltage regulation, the voltage feedback path to port 147 of PWM is effected by way of the opto-isolator 260. During power-up, the soft start circuit 240 limits the rate of rise of the voltage at PWM COMP port 146. In the event of an overload of the +5V output terminal 221, the voltage feedback path is by way of the current limit circuit 350. For overloads of multiple outputs or a (+100V), (–1OOV), (+15V), (–15V) fault upstream of the output current limit circuits of the regulator circuitry, it is possible for the transformer primary current to reach a level where the PWM output pulse width on line 142 is limited by the current feedback to the current sense input port 143.

As described briefly above, the modulated voltages across secondary windings 131–135 of power transformer 120 are rectified and filtered to provide respectively different magnitude output voltages (+/–105 VDC, +/–17 VDC, and +5 VDC/GND) at terminals 201–203, 211–213, 221–222.

For this purpose, a first pair of diodes 371, 372, which are capable of handling the very high peak reverse voltage across secondary winding terminals 374 and 375 are coupled in series between terminal 374 and a (+105V) unregulated output terminal 201. A capacitor 377 is coupled between terminals 201 and 203. Similarly, on the negative side (–105V), a second pair of diodes 381, 382 capable of handling the very high peak reverse voltage across secondary winding terminals 375 and 376 are coupled in series between terminal 376 and a (–105V) unregulated output terminal 202. A capacitor 383 is coupled between terminals 202 and 203.

For the unregulated +/–17 VDC secondary winding 133, a first diode 391 is coupled between terminal 394 and a (+17V) unregulated output terminal 211. A capacitor 397 is coupled between terminals 211 and 213. On the negative side (–17V), a second diode 392 is coupled between terminal 396 and a (–17V) unregulated output terminal 212. A capacitor 399 is coupled between terminals 212 and 213.

For the positive 5 VDC secondary winding 135, ripple filter circuit 330 is comprised of capacitors 401, 402, inductor 403 and capacitors 404, 405, coupled in a Pi filter architecture between torroid winding 323 and output terminal 221 and ground terminal 222. The +5 VDC output being unregulated, the ripple filter 330 functions to attenuate ripple voltage to a very small amplitude. Also, a resistor 411 and a capacitor 412 are provided to couple DC ground to chassis ground and thereby reduce conducted RFI emissions.

Figure 5:
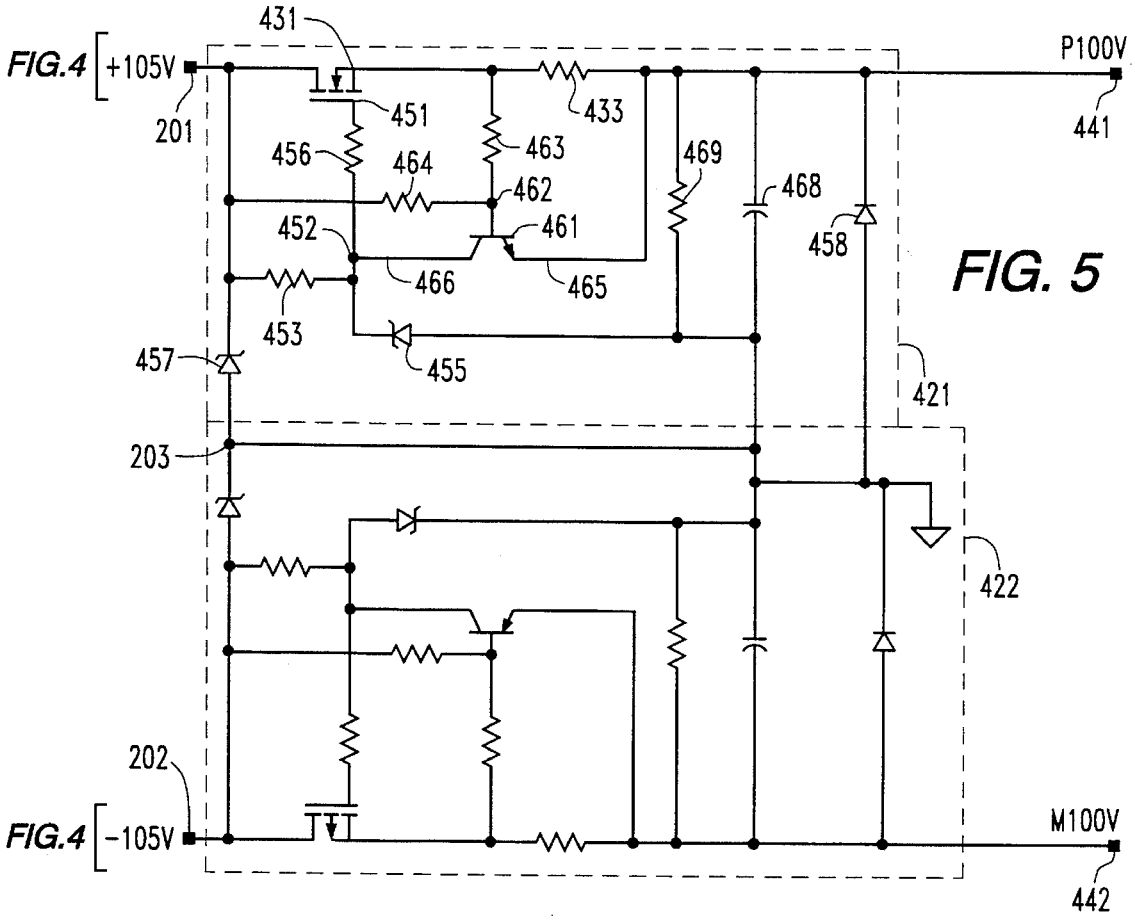
FIGS. 5 and 6 schematically show details of respective voltage regulator circuits of the regulator and current limit section C of the regulated power supply diagram of FIG. 1.
Figure 6:
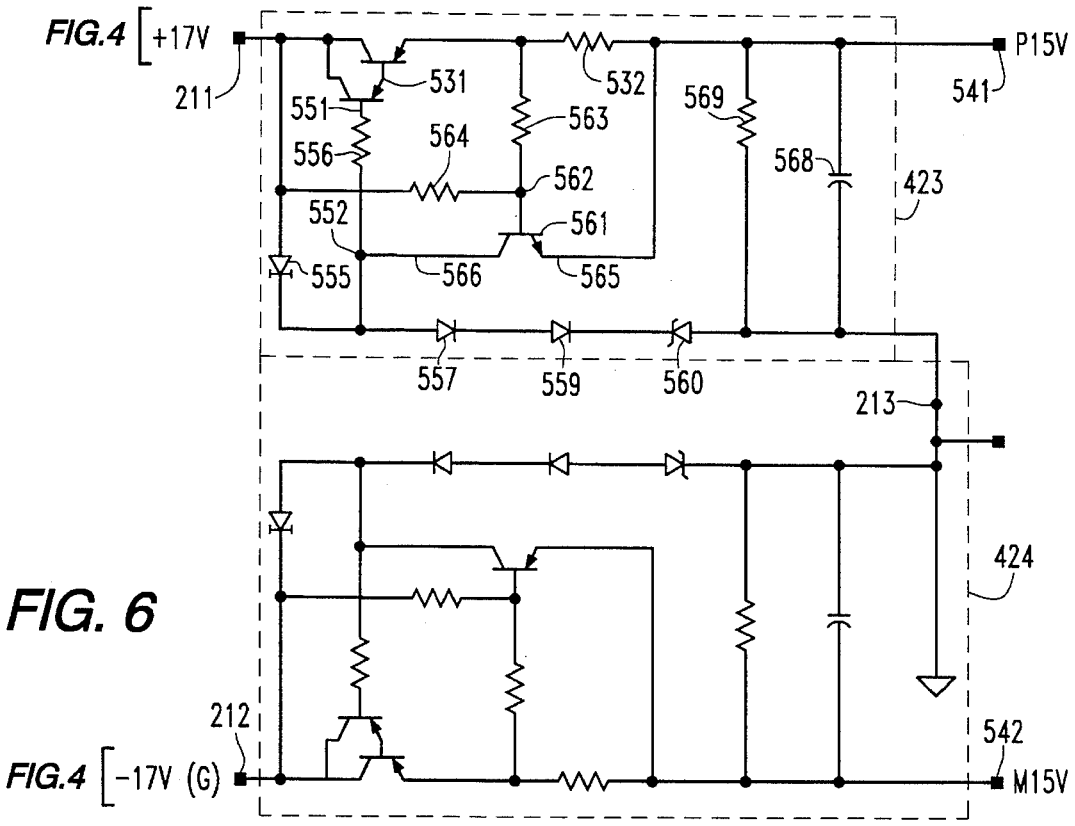

The rectified and filtered output voltages derived at respective output terminals 201–203, 211–213, from the secondary windings 131–134 of power transformer 120 are coupled to respective voltage regulator and current limiting circuits 421, 422, schematically shown in FIG. 5, and respective voltage regulator circuits 423 and 424, schematically shown in FIG. 6.

Referring to FIG. 5, voltage regulator circuit 421, to which the +105 rectified and filtered voltage at output terminal 201 is supplied, comprises a controlled MOSFET switch 431, the source-drain path of which is coupled in circuit with a current sense resistor 433 between (+105V) terminal 201 and a regulated output voltage terminal 441, from which a positive 100 volt regulated supply voltage is to be delivered. MOSFET switch 431 has its gate electrode 451 coupled to the common node 452 of a bias resistor 453 and a Zener diode 455, which are connected in series between terminal 201 and ground and provide a 'loosely' regulated positive 100 volt reference.

A series gate resistor 456 is coupled between node 452 and the gate electrode 451 of MOSFET 431 and serves to inhibit potential oscillation of MOSFET 431. A Zener diode 457 is coupled between input terminal 201 and ground, and protects the regulator circuit from excessive unregulated voltage during fault conditions. A diode 458 is coupled between output terminal 441 and ground and protects the circuit from a reverse polarity voltage applied directly to output terminal 441.

A bipolar bias sink transistor 461 has its base 462 coupled through a resistor 463 to one end of sense resistor 433 and through a resistor 464 to input terminal 201. The emitter 465 of transistor 461 is coupled to the other end of sense resistor 433, so that current flow through sense resistor establishes the base-emitter control voltage of transistor 461. The collector 466 of transistor 461 is connected to node 452. A capacitor 468 is connected between output terminal 441 and ground to provide a high frequency low impedance bypass path to ground, while parallel resistor 469 serves as a bleeder resistor.

The operation of regulator circuit 421 is straightforward, with bipolar transistor 461 controlling the gate drive to MOSFET 431 in accordance with the current through sense resistor 433 located in the current flow path between the unregulated input terminal 201 and the regulated output terminal 441.

For the minus 100 volt regulated output, a complementary polarity, mirror image of voltage regulator circuit 421, surrounded by broken lines 422, is employed to provide a regulated negative 100 volt output at a terminal 442 from the (–105V) unregulated voltage provided at terminal 202.

For the unregulated (+) and (–) 17 volt outputs on ports 211 and 212, regulation to (+) and (–) 15 volts is effected by means of the circuits shown in broken lines 423 and 424 in FIG. 6, which are effectively architecturally and functionally equivalent to the regulation circuitry of FIG. 5.

More particularly, for the unregulated (+)17 volts provided by terminal 211, voltage regulator circuit 423, to which the (+)17 VDC rectified and filtered voltage at output terminal 211 is supplied, comprises a controlled Darlington NPN bipolar transistor pair 531 the collector-emitter path of which is coupled in circuit with a current sense resistor 533 between terminal 211 and a regulated output voltage terminal 541, from which a positive (+)15 volt regulated voltage is to be supplied. Darlington pair 531 has its base input 551 coupled to the common node 552 of a current regulator diode 555 and a series connection of signal diodes 557 and 559 and a Zener diode 560 which are connected in circuit between terminal 211 and ground and provide a 'loosely' regulated positive 15 volt reference.

A series base resistor 556 is coupled between node 552 and the base input 551 of Darlington pair 531. A bias sink bipolar NPN transistor 561 has its base 562 coupled through a resistor 563 to one end of sense resistor 533 and through a resistor 564 to terminal 211. Resistor 556 inhibits possible oscillation of the Darlington pair 531. The emitter 565 of sink transistor 561 is coupled to the other end of sense resistor 533, so that current flow through sense resistor 533 establishes the base-emitter control voltage of transistor 561. The collector 566 of sink transistor 561 is connected to node 552. A capacitor 568 is connected between output terminal 541 and ground, to provide a high frequency low impedance bypass path to ground, while parallel resistor 569 serves as a bleeder resistor.

Like regulator 421 of FIG. 5, the operation of the regulator circuit 423 of FIG. 6 is straightforward, with bipolar transistor 561 controlling the base drive to Darlington pair 531 in accordance with the current through sense resistor 533 located in the current flow path between the unregulated input terminal 211 and the regulated output terminal 541.

A complementary polarity, mirror image of voltage regulator circuit 423, surrounded by broken lines 424, is employed to provide a regulated minus or negative 15 volt output at a terminal 542 from the (–17V) unregulated input at terminal 212.

As will be appreciated from the foregoing description, the regulated power supply of the present invention obviates the above-described shortcomings of conventional power supply systems employed in communication signal processing applications by means of a circuit architecture that automatically accommodates the polarity of the connection of the power supply circuit to the power source and without regard as to whether the source is an DC source, such as a –48 VDC source, or an AC source, such as a 117 VAC source. Moreover, the open fuse detector and alarm circuit immediately alerts servicing personnel to an open or blown condition of a user-replaceable input fuse, which protects the power supply circuit from excessive input current.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. A regulated power supply circuit comprising:

a source voltage conditioning circuit having input terminals to which either a DC power source or an AC power source are directly connectable without preference to polarity of the power source terminals, and operating from a range of input voltage sources, said source voltage conditioning circuit being operative to output a rectified and filtered intermediate voltage at an output thereof, said source voltage conditioning circuit including a severable fuse device coupled in a circuit path between said input terminals and said output terminal, to which a pulse width modulator-driven DC-DC converter is coupled, and further including an open fuse detector coupled to said circuit path and being operative by either said DC power source or said AC power source without preference to polarity of said power source terminals to provide an open fuse indication in response to the occurrence of an open fuse condition of said severable fuse device;

a pulse width modulator-driven DC-DC converter having a power transformer, which includes a primary winding and a plurality of secondary windings, and a drive circuit therefor, said drive circuit being operative to controllably drive said primary winding with said rectified and filtered intermediate voltage in accordance with a pulse width modulated signal provided by said pulse width modulator;

respective secondary rectification and filtering circuits coupled to respective ones of said plurality of secondary windings and being operative to provide a plurality of different amplitude unregulated DC voltages; and voltage regulator circuits coupled to respective ones of said respective secondary rectification and filtering circuits and being operative to provide a plurality of different amplitude regulated and current-limited DC voltages, and wherein said drive circuit for said drive pulse width modulator-driven DC-DC converter comprises a plurality of power switch MOSFETs, having their source-drain paths coupled in circuit with said primary winding and said rectified and filtered intermediate voltage, and being operative to controllably drive said primary winding with said rectified and filtered intermediate voltage in accordance with a pulse width modulated signal provided by said pulse width modulator, said power switch MOSFETs have their source terminals coupled through a primary current sense filter and attenuator circuit to a current sense input port of said pulse width modulator, said filter and attenuator circuit providing a current limit level signal for controlling the pulse width of the pulse width modulated signal provided by said pulse width modulator, said pulse width modulator includes a voltage feedback port to which an error feedback signal from a selected secondary winding of said power transformer is coupled for controlling the pulse width of the pulse width modulated signal provided by said pulse width modulator, said DC-DC converter further includes an error amplifier coupled in a feedback path from said selected secondary winding of said power transformer for providing said error feedback signal for controlling the pulse width of the pulse width modulated signal provided by said pulse width modulator, said DC-DC converter further includes an opto-isolator coupled in circuit with said error amplifier for providing said error feedback signal for controlling the pulse width of the pulse width modulated signal provided by said pulse width modulator, and said opto-isolator has a first input coupled to said selected secondary winding of said power transformer, a second input coupled to an output of said error amplifier, and further including a feedback voltage reference circuit which provides a prescribed reference voltage derived from said selected winding of said power transformer to a first input of said error amplifier, and further including a trimmable resistor network which is operative to couple a feedback voltage derived from said selected secondary winding to a second input of said error amplifier.

2. A regulated power supply circuit comprising:

a source voltage conditioning circuit having input terminals to which either a DC power source or an AC power source are directly connectable without preference to polarity of the power source terminals, and operating from a range of input voltage sources, said source voltage conditioning circuit being operative to output a rectified and filtered intermediate voltage at an output thereof, said source voltage conditioning circuit including a severable fuse device coupled in a circuit path between said input terminals and said output terminal, to which a pulse width modulator-driven DC-DC converter is coupled, and further including an open fuse detector coupled to said circuit path and being operative by either said DC power source or said AC power source without preference to polarity of said power source terminals to provide an open fuse indication in response to the occurrence of an open fuse condition of said severable fuse device;

a pulse width modulator-driven DC-DC converter having a power transformer, which includes a primary winding and a plurality of secondary windings, and a drive circuit therefor, said drive circuit being operative to controllably drive said primary winding with said rectified and filtered intermediate voltage in accordance with a pulse width modulated signal provided by said pulse width modulator;

respective secondary rectification and filtering circuits coupled to respective ones of said plurality of secondary windings and being operative to provide a plurality of different amplitude unregulated DC voltages; and voltage regulator circuits coupled to respective ones of said respective secondary rectification and filtering circuits and being operative to provide a plurality of different amplitude regulated and current-limited DC voltages, wherein said selected secondary winding of said power transformer is coupled to a current limit circuit which is operative to monitor the rectified current from said selected secondary winding, and wherein said current limit circuit is coupled to a voltage feedback port of said pulse width modulator is operative to apply an input to said voltage feedback port in response to said rectified current from said selected secondary winding exceeding a prescribed threshold, thereby causing said pulse width modulator to adjust said pulse width modulated signal, and wherein said selected secondary winding of said power transformer is coupled to said current limit circuit through a magnetic coil magnetically coupled with a torroid winding which is coupled in circuit with said selected secondary winding.

3. A regulated power supply circuit comprising:

a source voltage conditioning circuit having input terminals to which either a DC power source or an AC power source are directly connectable without preference to polarity of the power source terminals, and operating from a range of input voltage sources, said source voltage conditioning circuit being operative to output a rectified and filtered intermediate voltage at an output thereof, said source voltage conditioning circuit including a severable fuse device coupled in a circuit path between said input terminals and said output terminal, to which a pulse width modulator-driven DC-DC converter is coupled, and further including an open fuse detector coupled to said circuit path and being operative by either said DC power source or said AC power source without preference to polarity of said power source terminals to provide an open fuse indication in response to the occurrence of an open fuse condition of said severable fuse device;

a pulse width modulator-driven DC-DC converter having a power transformer, which includes a primary winding and a plurality of secondary windings, and a drive circuit therefor, said drive circuit being operative to controllably drive said primary winding with said rectified and filtered intermediate voltage in accordance with a pulse width modulated signal provided by said pulse width modulator;

respective secondary rectification and filtering circuits coupled to respective ones of said plurality of secondary windings and being operative to provide a plurality of different amplitude unregulated DC voltages; and voltage regulator circuits coupled to respective ones of said respective secondary rectification and filtering circuits and being operative to provide a plurality of different amplitude regulated and current-limited DC voltages, and wherein said open fuse detector comprises a first bridge rectifier coupled to the line upstream of severable fuse device, and a second bridge rectifier which is coupled downstream of said severable fuse device, said first bridge rectifier having a return path to said circuit path the line for supplying the power to said open fuse detector.

4. A regulated power supply circuit according to claim 3, wherein said open fuse detector includes an opto-isolator, which is coupled to a gate of a MOSFET switch, said MOSFET switch having a source-drain path coupled in circuit with a light emitting diode and an alarm relay, contacts of which are connectable to an alarm device, and wherein, in the absence of an open fuse condition, said second bridge rectifier drives said opto-isolator so as to keep said MOSFET switch turned-off, but in the event of an open fuse condition, said second downstream bridge rectifier becomes decoupled from said circuit path and no longer drives said opto-isolator, whereby gate drive to said MOSFET switch turns said MOSFET switch on, causing said light emitting diode to be illuminated and operating said alarm relay.

5. For use with a power supply having a severable fuse device coupled in a circuit path between power supply input terminals and a power supply control circuit from which output power is controllably supplied, an open fuse detector coupled to said circuit path and being operative to provide an open fuse indication in response to the occurrence of an open fuse condition of said severable fuse device, said open fuse detector including a first bridge rectifier coupled to the line upstream of said severable fuse device, and a second bridge rectifier which is coupled downstream of said severable fuse device, said first bridge rectifier having a return path to said circuit path the line for supplying power to said open fuse detector, and a controlled switching circuit coupled in circuit with a light emitting diode and an alarm relay, contacts of which are connectable to an alarm device, and wherein, in the absence of an open fuse condition, said second bridge rectifier places said controlled switching circuit in a first switching state, but in the event of an open fuse condition, said second bridge rectifier becomes decoupled from said circuit path and causes said controlled switching circuit to be placed in a second switching state, causing said light emitting diode to be illuminated and operating said alarm relay.

6. A regulated power supply circuit according to claim 5, wherein said controlled switching circuit comprises an opto-isolator, which is coupled to a gate of a MOSFET switch, said MOSFET switch having a source-drain path coupled in circuit with said light emitting diode and said alarm relay, contacts of which are connectable to an alarm device, and wherein, in the absence of said open fuse condition, said second bridge rectifier drives said opto-isolator so as to keep said MOSFET switch turned-off, but in the event of an open fuse condition, said second bridge rectifier becomes decoupled from said circuit path and no longer drives said opto-isolator, whereby gate drive to said MOSFET switch turns said MOSFET switch on, causing said light emitting diode to be illuminated and operating said alarm relay.

* * * * *